US005839102A

United States Patent [19]

Haagen et al.

[11] Patent Number: 5,839,102

[45] Date of Patent: Nov. 17, 1998

[54] SPEECH CODING PARAMETER SEQUENCE RECONSTRUCTION BY SEQUENCE CLASSIFICATION AND INTERPOLATION

[75] Inventors: Jesper Haagen, Lyngby; Willem Bastiaan Kleijn, Basking Ridge, both of N.J.

[73] Assignee: Lucent Technologies Inc., Murray Hill, N.J.

[21] Appl. No.: 346,798

[22] Filed: Nov. 30, 1994

[51] Int. Cl.[6] ..... G10L 9/18

[52] U.S. Cl. ..... 704/230; 704/212; 704/265; 704/501

[58] Field of Search ..... 395/2.3, 2.33, 395/2.14, 2.91, 2.92, 2.94, 2.95, 2.15, 2.32, 2.23, 2.39, 2.73, 2.74, 2.2, 2.31, 2.21, 2.76

[56] References Cited

U.S. PATENT DOCUMENTS

| | | | |
|---|---|---|---|
| 3,597,619 | 8/1971 | Little et al. | 250/202 |
| 4,680,797 | 7/1987 | Benke | 395/2.2 |
| 4,821,324 | 4/1989 | Ozawa et al. | 395/2.25 |
| 4,852,179 | 7/1989 | Fette | 395/2.39 |
| 5,301,266 | 4/1994 | Kimura | 395/139 |
| 5,351,338 | 9/1994 | Wigren | 395/2.28 |
| 5,355,430 | 10/1994 | Huff | 395/2.32 |
| 5,416,613 | 5/1995 | Rolleston et al. | 358/518 |
| 5,517,595 | 5/1996 | Kleijn | 395/2.14 |

OTHER PUBLICATIONS

U. S. Patent application "Method And Apparatus For Prototype Waveform Speech Coding" by W. B. Kleijn, Ser. No. 08/179,831.

B. S. Atal, "High–Quality Speech at Low Bit Rates: Multi–Pulse and Stochastically Excited Linear Predictive Coders," *ICASSP 86,* Tokyo, 1681–1684 (1986).

W. B. Kleijn and J. Haagen, "Transformation and Decomposition of the Speech Signal for Coding," *IEEE Signal Processing Letters,* vol. 1, No. 9, 136–138 (Sep. 1994).

T. E. Tremain, "The Government Standard Linear Predictive Coding Algorithm: LPC–10," *Speech Technology,* 40–49 (Apr. 1982).

W. B. Kleijn, "Encoding Speech Using Prototype Waveforms," *IEEE Transactions on Speech and Audio Processing,* vol. 1, No. 4, 386–399 (Oct. 1993).

*Primary Examiner*—David R. Hudspeth
*Assistant Examiner*—Donald L. Storm
*Attorney, Agent, or Firm*—Kenneth M. Brown

[57] ABSTRACT

A method and apparatus which allows the transmission of the perceptually important features of a speech-coding parameter at a low bit rate. The speech coding parameter may, for example, comprise the signal power of the speech. The parameter is processed on a block by block basis. The parameter value at the block boundaries is transmitted by conventional methods such as, for example, by means of differential quantization. The shape of the reconstructed parameter contour within block boundaries is based on a classification. The classification determines perceptually important features of the parameter contour within a block. The classification can be performed either at the transmitting end of the coder (using, for example, the original parameter contour with high time resolution and possibly other speech parameters as well) or at the receiving end of the coder (using, for example, the transmitted parameter values, and possibly other transmitted speech parameters as well). Based on the result of the classification as well as the parameter values at the block boundaries, a parameter contour (within the block) is selected from an inventory of possible parameter contours. The inventory may include a linear interpolation contour and a step function contour. The step function contour may be particularly useful when the features indicate the presence of a plosive. The inventory may adapt to the transmitted parameter values at the block boundaries.

30 Claims, 5 Drawing Sheets

SPEECH CODING PARAMETER SEQUENCE RECONSTRUCTION BY SEQUENCE CLASSIFICATION AND INTERPOLATION

FIELD OF THE INVENTION

The present invention is generally related to speech coding systems, and more specifically to parameter quantization in speech coding systems.

BACKGROUND OF THE INVENTION

Speech coding systems function to provide codeword representations of speech signals for communication over a channel or network to one or more system receivers. Each system receiver reconstructs speech signals from received codewords. The amount of codeword information communicated by a system in a given time period defines the system bandwidth and affects the quality of the speech received by system receivers.

The objective for speech coding systems is to provide the best trade-off between speech quality and bandwidth, given side conditions such as the input signal quality, channel quality, bandwidth limitations, and cost. The speech signal is represented by a set of parameters which are quantized for transmission. Perhaps most important in the design of a speech coder is the search for a good set of parameters (including vectors) to describe the speech signal. A good set of parameters requires a low system bandwidth for the reconstruction of a perceptually accurate speech signal. In addition, a desirable feature of a parameter set is that the parameters are independent. When the parameters are independent, the quantizers can be designed independently and incorrectly received information will affect the reconstructed speech signal quality less. The bandwidth required for each parameter is a function of the rate at which it changes, and the accuracy with which the trajectory of the parameter value(s) must be described to obtain reconstructed speech of the required quality.

The speech signal power is desirable as one parameter of a set of coding parameters. Other parameters are easily made independent of the signal power. Furthermore, the signal power represents a physical feature of the speech signal, facilitating the definition of design criteria for a quantizer. The signal power can be defined as the signal energy per sample, averaged over one pitch period for quasi-periodic speech segments and over some pre-determined interval for nonperiodic segments. The interval for nonperiodic segments should be sufficiently short to be perceptually relevant (advantageously 5 ms or less). Using this definition, the speech-signal power is a smooth function during sustained vowels and clearly displays onsets and plosives.

Estimation of the signal power with high resolution cannot be obtained with a fixed and/or large window size. A large window size for the estimation leads to a low time resolution of the estimated signal power. As a result, speech reconstructed with low-rate coders using this approach generally suffers from a lack of crispness. On the other hand, a short, fixed window leads to fluctuation of the signal power. Thus, coders which employ short fixed windows such as Code-Excited-Linear-Predictive (CELP) coders generally do not use the signal power as an explicit parameter. (See, e.g., B. S. Atal, "High-Quality Speech at Low Bit Rates: Multi-Pulse and Stochastically Excited Linear Predictive Coders," Proc. Int. Conf. Acoust. Speech Sign. Process., Tokyo, pp. 1681–1684, 1986.)

With the demand for increased coding efficiency, an increasing number of coders are expected to use the signal power as an explicit parameter to be coded separately. Recently, coding procedures have been introduced which describe the speech signal in terms of characteristic waveforms, sampled at a high rate (about 500 Hz). (See, e.g., W. B. Kleijn and J. Haagen, "Transformation and Decomposition of the Speech Signal for Coding," IEEE Signal Processing Letters, Vol. 1, September 1994, pp. 136–138.) In these so-called "waveform interpolation" coders, the signal power estimation window is one pitch-period (for voiced speech). These new waveform interpolation coders use an analysis which renders a very accurate signal power estimate with a high time resolution. The signal power is encoded separately.

In conventional coding techniques using the signal power as an explicit parameter, the signal power is transmitted at a relatively low rate. Linear interpolation over the long update intervals is then used to reconstruct the signal power contour (often this interpolation is applied to the log of the power). (See, e.g., T. E. Tremain, "The Government Standard Linear Predictive Coding Algorithm," Speech Technology, pp. 40–49, April 1982.) A more detailed description of the power contour would improve the reconstructed signal quality. The challenge, however, is to transmit only the perceptually relevant details of the signal power contour, so that a low bit rate can still used.

SUMMARY OF THE INVENTION

The present invention provides a method and apparatus which allows the transmission of the perceptually important features of a speech-coding parameter at a low bit rate. The speech coding parameter may, for example, comprise the signal power of the speech. The parameter is processed on a block by block basis. The parameter value at the block boundaries is transmitted by conventional methods such as, for example, by means of differential quantization. Then, in accordance with the present invention, the shape of the reconstructed parameter contour within block boundaries is based on a classification. The classification depends upon perceptually important features of the parameter contour within a block. The classification can be performed either at the transmitting end of the coder (using, for example, the original parameter contour with high time resolution and possibly other speech parameters as well) or at the receiving end of the coder (using, for example, the transmitted parameter values, and possibly other transmitted speech parameters as well). Based on the result of the classification as well as the parameter values at the block boundaries, a parameter contour (within the block) is selected from an inventory of possible parameter contours. The inventory may adapt to the transmitted parameter values at the block boundaries.

DETAILED DESCRIPTION

Introduction

Figure 1:
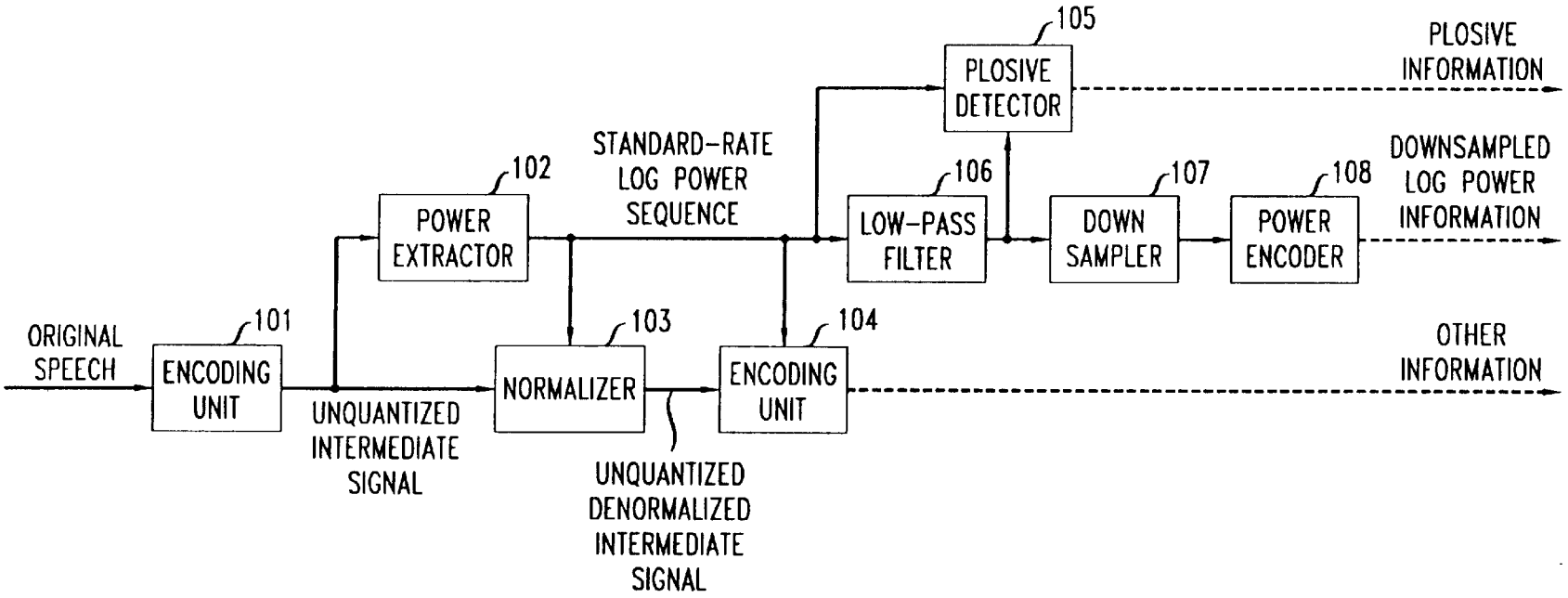
FIG. 1 presents an overview of the transmitting part of an illustrative coding system having signal power as an explicit parameter and encoding according to an illustrative embodiment of the present invention.

The objective of speech coding is to obtain a desired trade-off between reconstructed speech quality and required bandwidth, subject to channel quality, hardware, and delay constraints. Generally, a model is used for the speech signal, and the trajectory of the model parameters (which may be vectors) as a function of time is transmitted with a certain precision. (In the simplest model, the model parameter is the speech signal itself.) In a digital speech coder, the trajectory of the model parameters is described as a sequence of scalar or vector samples. The parameters may be transmitted at a low rate, and the trajectory is reconstructed by interpolation between the update points. Alternatively, a predictor (which may be a linear predictor) is used to predict a parameter from previous reconstructed samples, and only the difference (residual) between the actual and the predicted value is transmitted. In yet another procedure, a high time-resolution description of the parameter trajectory may be split into sequential blocks, which are then vector quantized for transmission. In some coders, vector quantization and prediction are combined.

In accordance with an illustrative embodiment of the present invention, the trajectory of a parameter (which may be a vector) is transmitted with a method that augments that of the above-described interpolation, prediction, and vector quantization procedures. The parameter is transmitted on a block-by-block basis, each block containing two or more parameter samples at the analysis side. The parameter signal is low-pass filtered and down-sampled. This down-sampled parameter sequence is transmitted according to conventional means. (In the illustrative embodiment described in the next section, for example, this conventional transmission employs a differential quantizer.) At the receiver, the parameter sequence must be upsampled to the rate required for reconstruction by the speech model. Obviously, signal features are lost when band-limited or linear interpolation is used for the upsampling. In accordance with an illustrative embodiment of the present invention, classification is used to identify perceptually important features of the parameter trajectory which are not otherwise present in a reconstructed parameter sequence that has been based only on interpolation. Depending on the outcome of this classification, one trajectory from an inventory of trajectories is selected to construct the parameter trajectory between the samples at the block boundaries. Moreover, the inventory adapts to the parameter values at the block boundaries. The illustrative method described herein does not always require transmission of additional information—the classification is performed at the receiving end of the coder, using only the transmitted down-sampled parameter sequence.

An Illustrative Embodiment

In the illustrative embodiment presented herein the above-described procedure s applied in particular to the speech power. It has been found that a stepped speech-power contour sounds significantly different from a smooth speech-power contour. The stepped contour is common in voicing onsets, while a smooth contour is typical of sustained speech sounds. A simple classification scheme using the transmitted down-sampled speech-power sequence can identify stepped speech-power contours with high reliability. A stepped contour is then used for the reconstructed signal power sequence. Experiments have indicated that the precise location of the step in the speech-power signal is of only minor significance to the perceived speech quality.

Classification performed at the transmitting end of the coder can be used to identify features of the energy contour between samples, such as plosives. Again, the precise location of the reconstructed plosive is of only minor perceptual significance. Thus, a simple bump in the speech-power signal is added to the middle of the block whenever a plosive is identified at the transmitting end.

FIG. 1 shows the transmitting part of an illustrative embodiment of the present invention performing signal-power extraction in a waveform-interpolation coder. The original speech signal is first processed in encoding unit 101. In the waveform interpolation coder, this encoding unit extracts the characteristic waveforms. These characteristic waveforms correspond to one pitch cycle during voiced speech. Following known methods, the speech signal is represented by a sequence of characteristic waveforms (defined in the linear-prediction residual domain), a pitch period track, and the time-varying linear-prediction coefficients. Such techniques are described, for example, in co-pending U.S. Patent application "Method and Apparatus For Prototype Waveform Speech Coding" by W. B. Kleijn, Ser. No. 08/179,831, assigned to the assignee of the present invention, and hereby incorporated by reference as if fully set forth herein. (See also, e.g., W. B. Kleijn, "Encoding Speech Using Prototype Waveforms," IEEE Trans. Speech and Audio Processing, Vol. 1, No. 4, pp. 386–399, 1993 and W. B. Kleijn and J. Haagen, "Transformation and Decomposition of the Speech Signal for Coding,", IEEE Signal Processing Letters, Vol. 1, September 1994, pp. 136–138.)

The description of the characteristic waveform is usually in the form of a finite Fourier series. The characteristic waveform is described in the residual domain because this facilitates its extraction and quantization. Advantageously, the sampling (extraction) rate of the characteristic waveform is set to approximately 500 Hz. In this figure, as well as in the following figures, the pitch track and the linear-prediction coefficients are assumed to be available to all processing units which require these parameters. Both the pitch track and the linear-prediction coefficients are defined and interpolated in accordance with conventional methods.

The unquantized characteristic waveforms (labeled the unquantized intermediate signal in FIG. 1) are provided to power extractor 102. In power extractor 102 the residual-domain characteristic waveform is first converted to a speech-domain characteristic waveform by means of circular convolution with the linear-prediction synthesis filter. (This convolution can be performed directly on the Fourier series, for example, by means of equation (19) in W. B. Kleijn, "Encoding Speech Using Prototype Waveforms,"

IEEE Trans. Speech and Audio Processing, Vol. 1, No. 4, pp. 386–399, 1993.) The speech-domain signal power is used because it prevents transmission errors in the linear-prediction coefficients (which affect the linear-prediction filter gain) from affecting the speech signal power.

Power extractor 102 then computes the power of the characteristic waveform for each speech sample. The power is normalized on a per sample basis such that the signal power does not depend on the pitch period, thereby facilitating its quantization and making it insensitive to channel errors affecting the pitch period. Finally, power extractor 102 converts the resulting speech-domain power to the logarithm of the speech-domain power. For example, the well-known decibel ("db") log scale may be used for this purpose. (Use of the logarithm of the signal power rather than the linear signal power is motivated by characteristics of human perception. The human ear can deal with signal powers varying over many orders of magnitude.) This signal, which is sampled at the same rate as the characteristic waveforms, is provided to plosive-detector 105, low-pass filter 106, and normalizer 103. Normalizer 103 uses the extracted speech power to create a normalized characteristic waveform. This normalized characteristic waveform is further encoded in encoding unit 104, which may also use the signal power as side information.

To prevent aliasing, low-pass filter 106 removes frequencies beyond half the sampling frequency of the output signal of downsampler 107. For a 2.4 kb/s coder, the sampling frequency after down-sampling is advantageously set to 100 Hz (corresponding to a down sampling by a factor 5 in the given illustrative embodiment).

Power encoder 108 encodes the down-sampled log power sequence. Advantageously, this is done with a differential quantizer. Let x(n) be the log power at sampling time n. Then a simple scalar quantizer is used to quantize the difference signal e(n):

$$e(n)=x(n)-\alpha^{*}x(n-1). \tag{1}$$

Let Q(e(n)) represent the quantized value of e(n). Then, the reconstructed log power is:

$$\hat{x}(n)=Q(e(n))+\alpha^{*}x(n-1). \tag{2}$$

For $\alpha$ less than 1, equation (2) represents the well-known "leaky integrator." The function of the leaky integrator is to reduce the sensitivity to channel errors. Advantageously, the value $\alpha$=0.8 can be used.

Plosive detector 105 uses the unprocessed log power sequence and the low-pass filtered log power sequence. For each interval between the samples of the down-sampled log-power sequence (e.g., 10 ms based on a down-sampled sampling rate of 100 Hz), the output of the plosive detector is a binary decision: zero means no plosive was detected, while one means a plosive was detected.

Figure 3:
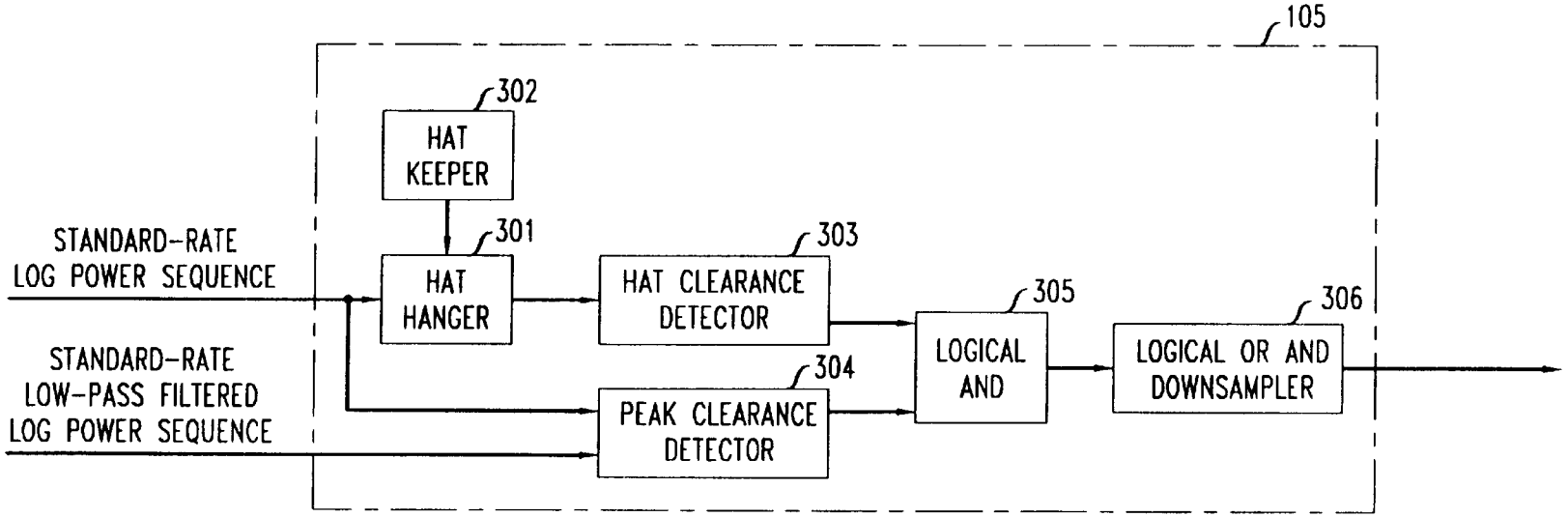
FIG. 3 presents an illustrative plosive detector for use in the illustrative transmitter of FIG. 1.

The operation of plosive detector 105 is shown in FIG. 3. Peak-clearance detector 304 determines whether the log power sample minus the equivalent sample of the low-pass filtered log power sequence is greater than a given threshold. (This threshold may, for example, advantageously be set to 16 db for the log of the signal power.) If this is the case the output of peak-clearance detector 304 is 1, otherwise its output is 0.

Figure 5:
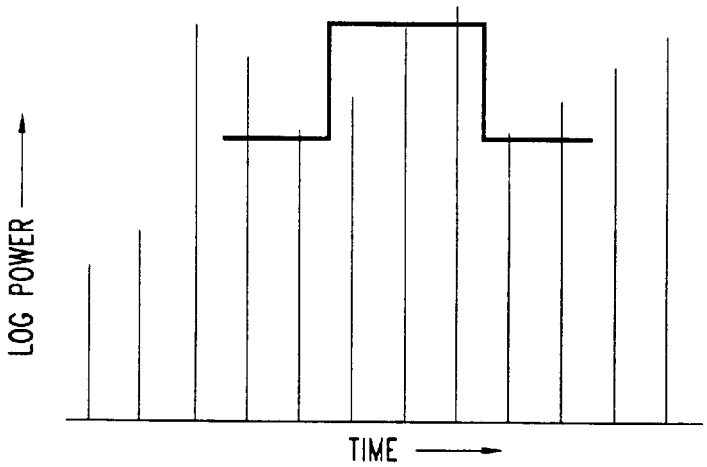
FIG. 5 presents the "hat-hanging" mechanism of the illustrative plosive detector of FIG. 3 operating in the case where no plosive is present.
Figure 6:
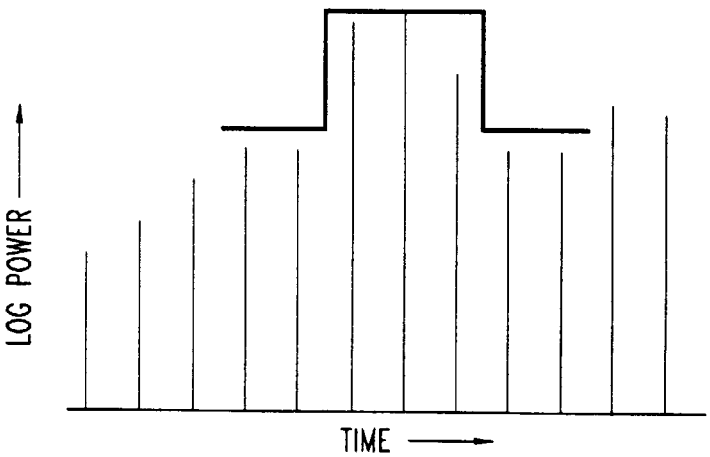
FIG. 6 presents the "hat-hanging" mechanism of the illustrative plosive detector of FIG. 3 operating in the case where a plosive is present.

The operation of hat hanger 301 is illustrated in FIGS. 5 and 6. Conceptually, a hat-shaped curve is "hung" from the current power signal sample. That is, the top of the "hat" is set to a level equal to that of the current sample. The output of hat-clearance detector 303 is 1 if the samples which are covered by the hat shape fit below the hat top and rim. FIG. 5, for example, shows a situation where the hat does not clear the neighboring samples—thus, the output of hat-clearance detector 303 is zero. FIG. 6, on the other hand, shows a situation where the hat does clear the neighboring samples—thus, the output of the hat-clearance detector 303 is one. The properties of the hat are stored in hat keeper 302. The hat shape can be varied within the detection interval, and the rim height can be different for the left and the right side. For example, the hat top width and rim width can each advantageously be set to 5 ms, the hat being symmetric, and the rim to top distance can advantageously be set to 12 db for a contour describing the log of the signal power. Those of skill in the art will recognize that hat-clearance detector 303 may, for example, be implemented with a sample memory and processor for testing sample levels and comparing those levels with given predetermined threshold values.

Logical "and" operator 305 combines the outputs from peak-clearance detector 304 and hat-clearance-detector 303. If any one of these two outputs is zero the output of logical and operator 305 is zero. Logical or and downsampler 306 has one output for each interval of the down-sampled log-power sequence (i.e., the output of downsampler 107). For example, this would be one output per 10 ms for the example case described earlier. If the input to logical or and downsampler 306 is not zero at any time within this interval, then the output of logical or and downsampler 306 is set to one, indicating that a plosive has been detected. If the input is zero at all times within the interval, then the output of logical or and downsampler 306 is set to zero, indicating that no plosive has been detected.

Figure 2:
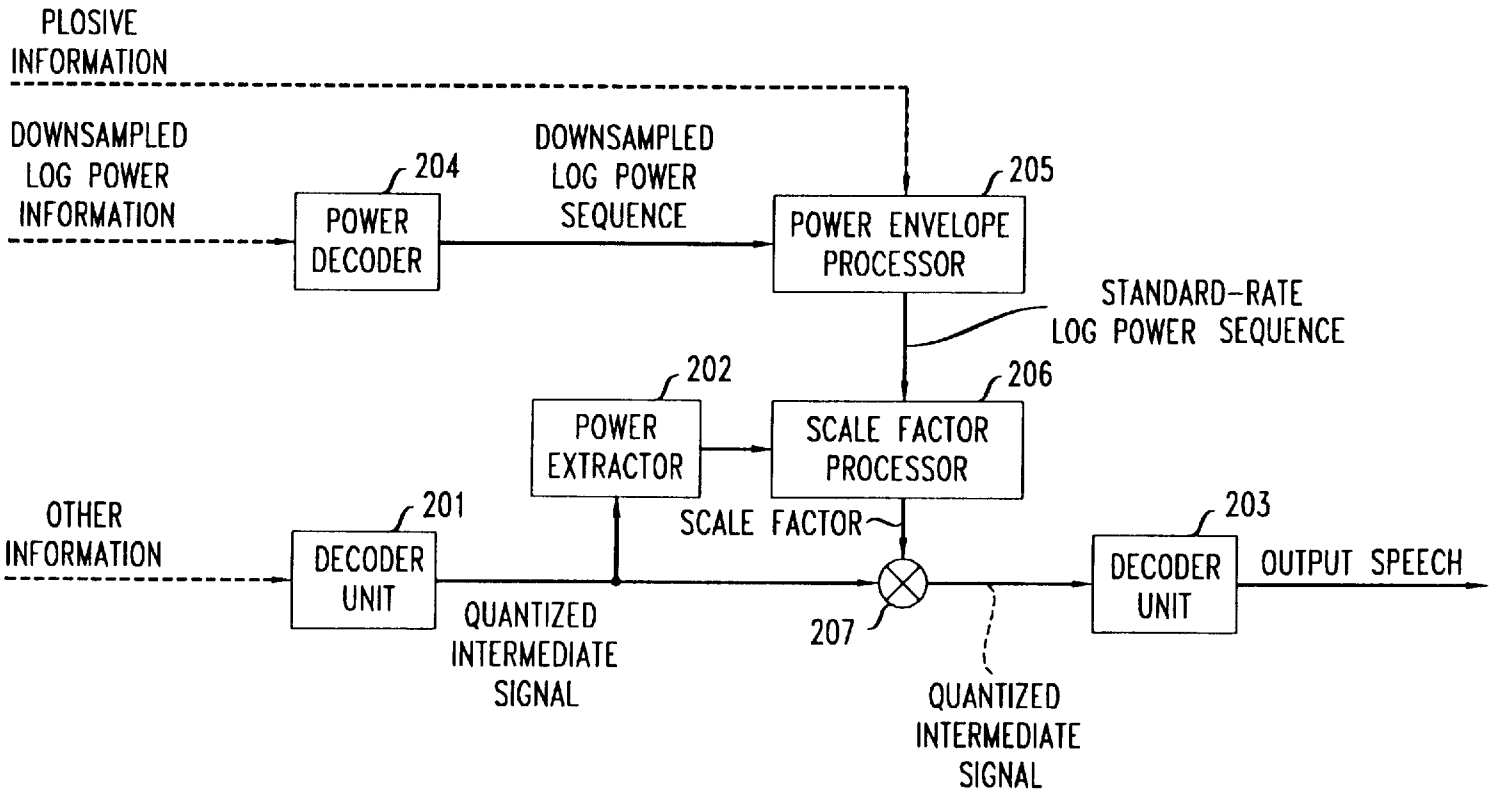
FIG. 2 presents an overview of the receiving part of an illustrative coding system having signal power as an explicit parameter and encoding according to an illustrative embodiment of the present invention.

FIG. 2 shows the receiving part of the illustrative embodiment of the present invention corresponding to the transmitting part shown in FIG. 1. Decoder unit 201 reconstructs the characteristic waveforms. Some of the operations performed within decoder unit 201 do not correspond to operations performed at the transmitter. For example, to emphasize the spectral shape of the output signal, spectral pre-shaping may be added to the characteristic waveforms. This means that the characteristic waveforms which form the output of decoder unit 201 are, in general, not guaranteed to have normalized power. Thus, prior to scaling the quantized characteristic waveforms, their power must be evaluated. This is done by power extractor 202, which functions in an analogous manner to power extractor 102. Again, the power is evaluated in the speech domain.

Scale factor processor 206 determines the appropriate scale factor to be applied to the characteristic waveforms generated by decoder unit 201. For each characteristic waveform, the inputs to scale factor processor 206 are a log power value, reconstructed from transmitted information, and the power of the quantized characteristic waveform prior to scaling. The log power value is converted to a linear power value, and it is divided by the power of the unscaled quantized characteristic waveform. This division renders the appropriate scale factor for the unscaled quantized characteristic waveform. The resultant scale factor is used in multiplier 207, which has as its output the properly scaled quantized characteristic waveform. This characteristic waveform is the input for decoder unit 203, which converts the sequence of characteristic waveform description (with help of the pitch track, and the linear prediction coefficients) into the reconstructed speech signal. The well-known methods used in decoder unit 203 are described, for example, in U.S. patent application Ser. No. 08/179,831.

Figure 4:
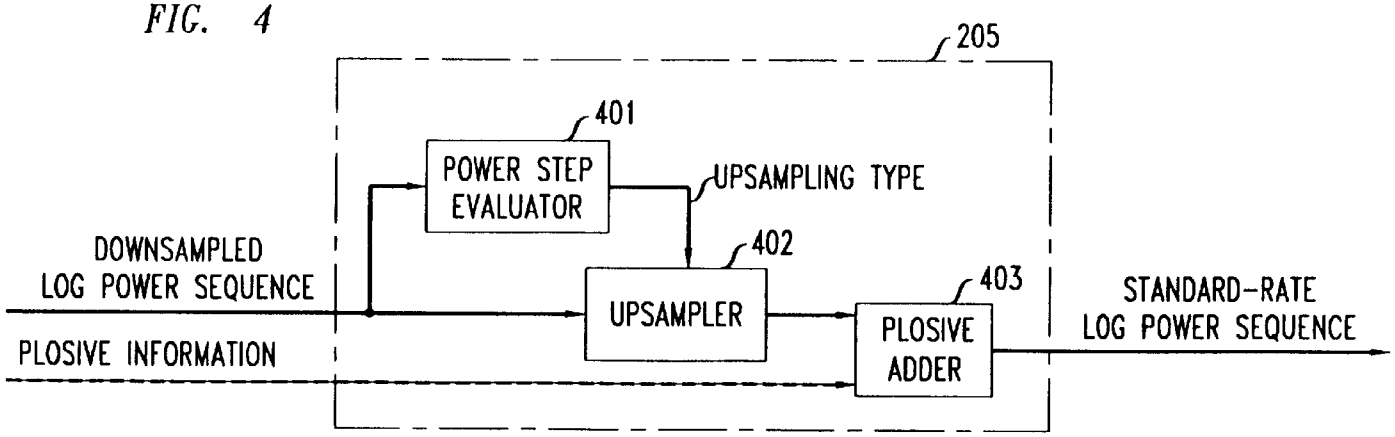
FIG. 4 presents an illustrative power envelope processor for use in the illustrative receiver of FIG. 2.
Figure 7:
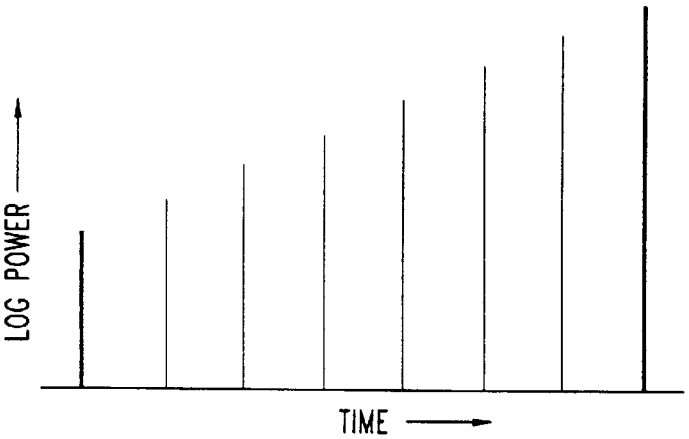
FIG. 7 presents a log signal power contour obtained by linear interpolation in accordance with an illustrative embodiment of the present invention.

The reconstruction of the log power sequence will now be explained. Power decoder 204 reconstructs a down-sampled, quantized log power sequence based on equation (2), above. Power envelope processor 205 converts this down-sampled sequence to an upsampled log power sequence. The operation of power envelope processor 205 is illustrated in detail in FIG. 4. First, the case where the plosive information is zero (indicating that no plosive is present) will be considered. Power-step evaluator 401 subtracts the previous log power value of the down-sampled sequence from the present log power value of the down-sampled sequence to determine the difference. Upsampler 402 upsamples the log power sequence in accordance with an upsampling procedure. Specifically, the upsampling procedure which is performed by upsampler 402 is selected on the basis of comparing the difference between the successive samples (as determined by power-step evaluator 401) with a threshold. For example, the threshold may advantageously be chosen to be 12 db for the log of the speech power and a sampling rate of 100 Hz. Linear interpolation between the update points is performed by upsampler 402 if the difference between the successive samples is less than the threshold. This is the case for most intervals and is illustrated in FIG. 7. FIG. 7 shows in bold lines two sample values for the down-sampled log power sequence. The samples between these two sample values are obtained by linear interpolation.

Figure 9:
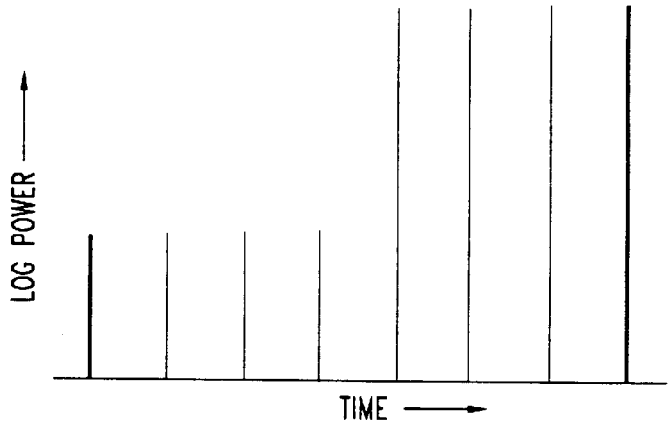
FIG. 9 presents a log signal power contour obtained by stepped interpolation in accordance with an illustrative embodiment of the present invention.
Figure 10:
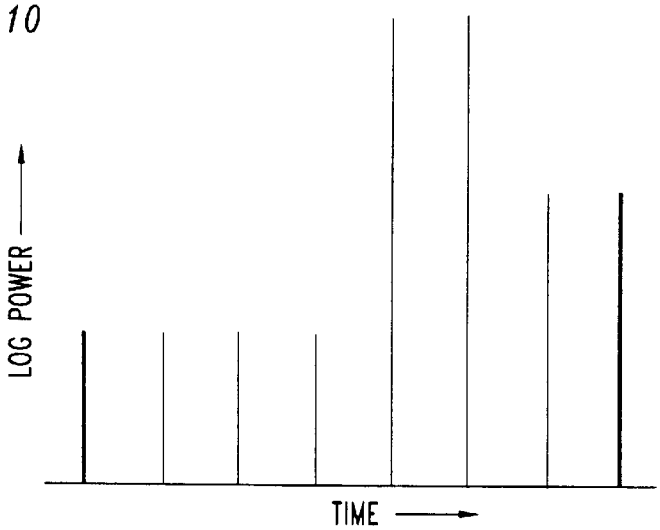
FIG. 10 presents a log signal power contour obtained by stepped interpolation and an added plosive in accordance with an illustrative embodiment of the present invention.

Larger increases in signal power, where the difference between the successive samples exceeds the threshold, occur mainly at sharp voicing onsets. Linear interpolation of the log power is not a good model for such onsets. In this case, therefore, upsampler 402 makes use of a stepped contour. Specifically, whenever the difference between successive samples exceeds the threshold, the left log power value (i.e., the previous sample) is used up to the midpoint of the interval, and the right log power value (i.e., the present sample) is used for the remaining part of the interval. This case is illustrated in FIG. 9. Note that, in general, the step will not be located at the same time instant as the onset in the original signal. However, for purposes of human perception, the exact location of the step in the power contour is less important than the fact that the interval includes a step rather than a smooth contour.

The perceptual effect of the use of stepped power contours is to make the reconstructed speech signal noticeably more crisp. However, indiscriminate use of stepped power contours results in significant deterioration of the output signal quality. Limiting the usage of the stepwise contour to cases where the signal power is changing rapidly results in improved speech quality as compared to consistent usage of a linearly interpolated contour. Moreover, use of the stepwise contour in cases where the signal power changes rapidly but smoothly does not affect the reconstructed speech significantly.

Figure 8:
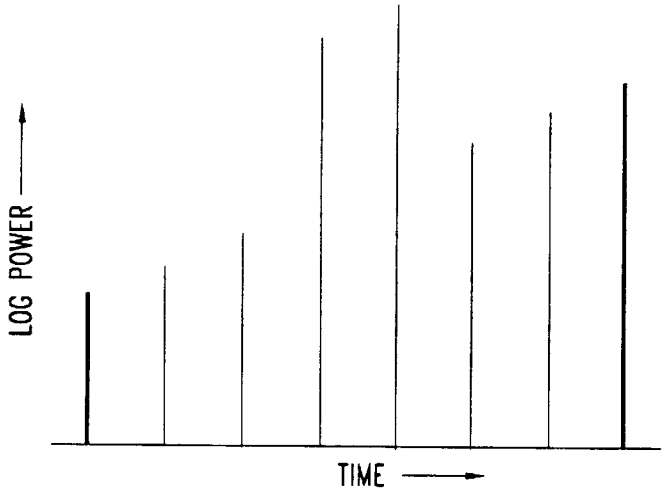
FIG. 8 presents a log signal power contour obtained by linear interpolation and an added plosive in accordance with an illustrative embodiment of the present invention.

Next, the case where the plosive information is one (indicating that a plosive is present) will be considered. Again, this is described with reference to FIG. 4. When a plosive is present, plosive adder 403 adds a fixed value to one-or-more specific samples of the upsampled log power sequence within the interval in which the plosive is known to be present. For example, the fixed value 1.2 may advantageously be used for the log of the signal power, and this value may advantageously be added to the log-power signal for a 5 ms period. FIG. 8 illustrates the addition of a plosive for the case of an otherwise linearly interpolated contour. FIG. 9 illustrates the addition of a plosive for the case of a stepwise contour. In the latter case the plosive is advantageously added after the step—otherwise, it would not be audible.

The illustrative embodiment of the present invention described above comprises two related, but distinct, classification procedures. As is shown, for example, in FIG. 4, power step evaluator 401 determines whether the log power contour between two successive samples is to be interpolated linearly or whether a stepped contour is to be provided. In addition, plosive adder 403 determines whether a plosive is to be added to the log power contour between the two successive samples. In other illustrative embodiments of the present invention, either one of these procedures may be performed independently of the other.

For clarity of explanation, the illustrative embodiment of the present invention is presented as comprising individual functional blocks or "processors." The functions these blocks represent may be provided through the use of either shared or dedicated hardware, including, but not limited to, hardware capable of executing software. For example, the functions of processors presented in FIGS. 1–4 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

APPENDIX

```
#include "macro.h"
#include "hatshapes.h"
/*****************************************************************
 * finds plosives
 * strategy: 1) searches for certain shape characteristics in the
 *           unsmoothed energy contour (shapes given by "hatshapes")
 *           2) measures the energy excursions between the unsmoothed
 *           and the smoothed energy contour
 *****************************************************************/
void plosive search( frame, fcnt)
struct frames *frame;        /* out/in: frame to quant/dequant */
long fcnt;                   /* input : frame count */
```

APPENDIX-continued

```
{
    int i, j, k, l;
    int step;
    int hat_fit, left_ok, right_ok, energy_ok, plosive_ok;
    float top_level, 1_level, r_level, ener_diff;
    float *pth;
    struct protot *pprt, *pprt1, *pprt2;
    /* initialize */
    step = frame->protno/frame->enno;          /* number of prot between updates */
    pprt = frame->proto;                       /* point to first prot in frame */
    /* loop over subframes */
    for( i=0; i<frame->enno; i++){
        /* check if there is a plosive in subframe */
        plosive_ok = 0; k = 0;
        while( (plosive_ok == 0) && (k++ < hatnum)){      /* select hats */
            for( pprt1=pprt, j=0; j<step; j++, pprt1=pprt1->next){
                /* put the hat on unsmoothed energy contour */
                pth = hatshape+(k-1)*hatdim; /* pointer to hat features */
                top_level = 0.0;
                for( pprt2=pprt1, 1=0; 1< *(pth+2); 1++, pprt2=pprt2->next)
                  top_level += pprt2->enerls;
                top_level /= *(pth+2);
                l—level = top_level-( *(pth+3) - *(pth+1));
                r_level = top_level-( *(pth+3) - *(pth+5));
                /* test if the hats rim touches unsmoothed energy contour */
                hat_fit = 0;
                pprt2 = pprtl->prev; left_ok = 1; l = 0;
                while( (left_ok == 1) && (1++ < *pth)){
                  if( l_level < pprt2->enerls) left_ok = 0;
                  pprt2=pprt2->prev;
                }
                for( pprt2=pprt1, l=0; 1< *(pth+2); 1++) pprt2=pprt2->next;
                right_ok = 1; 1 = 0;
                while( (left_ok == 1) && (right_ok == 1) && (1++ < *(pth+4))){
                  if( r_level < pprt2->enerls) right_ok = 0;
                  pprt2=pprt2->next;
                }
                if( (left_ok==1) && (right_ok==1)) hat_fit = 1;
                /* check energy difference between smoothed and unsmoothed */
                energy_ok = 0;
                pprt2 = pprt1; 1 = 0; ener_diff = 0.0;
                while( (hat_fit == 1) && (energy_ok == 0) && (1++ < *(pth+2))){
                  ener_diff += (pprt2->enerls - pprt2->enerlsf);
                  if( ener_diff >= 0.80) energy_ok = 1;
                }
                /* test if hat fits and energy difference is significant */
                if( (hat_fit == 1) && (energy_ok == 1)) plosive_ok = 1;
            }
        }
        /* final decision */
        if( plosive_ok == 1 )
            frame->plindex[i] = 1;
        else
            frame->plindex[i] = 0;
        /* update pointer to next subframe */
        for( j=0; j<step; j++) pprt = pprt->next;
    }
}
/*****************************************************************
 *
 *****************************************************************/
void plosive_add( frame, fcnt)
struct frames *frame;          /* out/in: frame to quant/dequant */
long fcnt;                     /* input : frame count */
{
    int i,j;
    int step;                  /* down sampling step size */
    float oldenerlsq;          /* old quantized energy */
    float newenerlsq;          /* new quantized energy */
    struct protot *lproto, *rproto;
    step = frame->protno/frame->enno;
    rproto = frame->protq[0].prev;
    lproto = frame->protq[0].prev;
    for( i=0; i<frame->enno; i++){
        oldenerlsq = lproto->enerlsq;
        for( j=0; j<step; j++) lproto = lproto->next;
        newenerlsq = lproto->enerlsq;
        printf("ener_quant:5 plosive=%d\n", frame->plindex[i]);
        if( newenerlsq > oldenerlsq+0.6){
```

APPENDIX-continued

```
            for( j=0; j<step/2+2; j++) rproto = rproto->next;
            if( frame->plindex[i] == 1){
                rproto->prev->enerlsq += 0.6;
/*              rproto->enerlsq += 0.8; */
            }
            for( j=0; j<step/2-2; j++) rproto = rproto->next;
}
        else{
            for( j=0; j<step/2; j++) rproto = rproto->next;
            if( frame->plindex[i] == 1){
                rproto->prev->enerlsq += 0.6;
/*              rproto->enerlsq += 0.8; */
            }
            for( j=0; j<step/2; j++) rproto = rproto->next;
        }
    }
}
/*************************************************************
 * This files contains "hatshapes" for detection of plosives
 * Decoding of shapes:
 * Coefficient #1: width of left rim
 *             #2: height of left rim
 *             #3: width of top
 *             #4: height of top
 *             #5: width of right rim
 *             #6: height of right rim
 *************************************************************/
static int hatnum = 11;
static int hatdim = 6;
static float hatshape[ ] = {
    2.0, 0.0, 4.0, 0.8, 2.0, 0.6,        /* 11. shape */
    2.0, 0.0, 3.0, 0.8, 3.0, 0.5,        /* 10. shape */
    2.0, 0.0, 3.0, 0.4, 2.0, 0.0,        /*  9. shape */
    3.0, 0.0, 3.0, 0.2, 3.0, 0.0,        /*  8. shape */
    3.0, 0.0, 2.0, 0.8, 3.0, 0.6,        /*  7. shape */
    3.0, 0.0, 2.0, 0.7, 4.0, 0.5,        /*  6. shape */
    2.0, 0.0, 2.0, 0.6, 2.0, 0.0,        /*  5. shape */
    3.0, 0.0, 2.0, 0.3, 3.0, 0.0,        /*  4. shape */
    4.0, 0.0, 2.0, 0.2, 3.0, 0.0,        /*  3. shape */
    3.0, 0.0, 1.0, 0.8, 3.0, 0.6,        /*  2. shape */
    2.0, 0.0, 1.0, 0.6, 2.0, 0.0};       /*  1. shape */
#include "macro.h"
/*****************************************************************
 *
 *****************************************************************/
void ener_quant( frame, cbnamee, cbnamed, dgain, ofcnt, plosive, mode)
struct frames *frame;          /* out/in: frame to quant/dequant*/
char *cbnamee;                 /* input : gain codebook file name encoder */
char *cbnamed;                 /* input : gain codebook file name decoder */
float dgain;                   /* input : leakage factor */
long ofcnt;                    /* input : frame count */
short plosive;                 /* input : *add plosive yes/no 1/0 */
short mode;                    /* input : mode:
                                  12=analyzer: quantize
                                  11=analyzer: copy_enerls_to_enerlsq
                                  10=analyzer: copy_enerls to_enerlsq
                                  02=synthesizer:dequantize_and_interpolate
                                  01=synthesizer: interpolate
                                  00=do_nothing */
{
#define CBSIZE14 16
    static short first=1;
    static int cbdim, cbsize;
    *int cbsized;
    static float *sigma2;
    static float cbe[2*CBSIZE14];
    static float cbd[CBSIZE14];
    int step;                  /* down sampling step size */
    struct protot *lproto, *rproto;
    float oldenerlsq;          /* old quantized energy */
    float newenerlsq;          /* new quantized energy */
    float diffenerls;          /* difference energy */
    int i,j;
    float f;
    static short enerbits;
    if( first == 1){           /* read codebook */
        readbook( cbe, &cbdim, &cbsize, cbnamee, 2 * CBSIZE14);
        sigma2 = cbe + cbdim * cbsize;
        if( cbdim != 1){printf("ener_quant not set up for vq\n"); exit(13);}
```

APPENDIX-continued

```
        readbook( cbd, &cbdim, &cbsized, cbnamed, CBSIZE14);
        if( cbdim != 1){ printf("ener_quant not set up for vq\n"); exit(13);}
        if( cbsized != cbsize)(printf("gain codebooks inconsistent\n");exit(1);}
        enerbits = 0.5 + log( (float)cbsize) / log(2);
        first = 0;
    }
    /* miscellaneous/initialization */
    frame->enbits = enerbits;
    step = frame->protno/frame->enno;
    f = 1.0 / (float)step;
    if( mode == 12){            /* mode = quantize */
        rproto = frame->protq[0].prev;
        for( i=0; i<frame->enno; i++){
            oldenerlsq = dgain * rproto->enerlsq;
            for( j=0; j<step; j++) rproto = rproto->next;
            diffenerls = rproto->enerlsf - oldenerlsq;
            scalarquant( frame->enindex+i, diffenerls, cbe, sigma2, cbsize);
            rproto->enerlsq = oldenerlsq + cbe[ frame->enindex[i]];
        }
    }
    if( (mode >= 10) && (plosive == 1)) /* detect plosives */
        plosive_search( frame, ofcnt);
    if( mode == 10      mode == 11){ /* mode = copy enerlsf to enerlsq */
        for (i=0,rproto=frame->protq; i<=frame->protno; i++,rproto=rproto->next)
            rproto->enerlsq = rproto->enerlsf;
    }
    if( mode == 2){             /* mode = dequantize */
        rproto = frame->protq[0].prev;
        for( i=0; i<frame->enno; i++){
            oldenerlsq = rproto->enerlsq;
            for( j=0; j<step; j++) rproto = rproto->next;
            rproto->enerlsq = dgain * oldenerlsq + cbd[ frame->enindex[i]];
        }
    }
    if( mode == 2 || mode == 1){ /* mode = interpolate */
        rproto = frame->protq[0].prev;
        for( i=0; i<frame->enno; i++){
            oldenerlsq = rproto->enerlsq;
            lproto = rproto->next;
            for( j=0; j<step; j++) rproto = rproto->next;
            newenerlsq = rproto->enerlsq;
            /* select interpolation method */
            if( newenerlsq > oldenerlsq+0.6){
                for( j=1; j<=step/2; j++, lproto=lproto->next)
                  lproto->enerlsq = oldenerlsq;
/*              lproto->enerlsq = oldenerlsq + (newenerlsq - oldenerlsq)*j*f*2;
/*
                for( j=1; j<step/2; j++, lproto=lproto->next)
                  lproto->enerlsq = newenerlsq;
            }
            else{
                for( j=1; j<step; j++, lproto=lproto->next)
                  lproto->enerlsq = oldenerlsq + (newenerlsq - oldenerlsq)*j*f;
            }
        }
    }
    if( (mode<10) && plosive == 1) /* add plosives */
        plosive_add( frame, ofcnt);
}
```

We claim:

1. A method of decoding a coded speech signal, the coded signal comprising a sequence of coded parameter value signals representing successive values of a predetermined parameter at successive times, the coded signal further comprising a coded intermediate parameter values signal representing values of the predetermined parameter at one or more times between the times of two of said successive values of the predetermined parameter, the method comprising the steps of:

classifying the predetermined parameter into one of a plurality of categories based on the coded intermediate parameter values signal;

generating, based on the category into which the predetermined parameter has been classified, one or more intermediate parameter value signals representing values of the predetermined parameter at one or more times between two consecutive ones of the coded parameter value signals; and decoding the coded speech signal based on the one or more intermediate parameter value signals, wherein the plurality of categories include at least one of (i) an interpolation category representing that each of said one or more intermediate parameter value signals is to be generated based on an interpolation of said two successive values of said predetermined parameter; and (ii) a step function category representing that each of said one or more intermediate parameter value signals is to be generated based on exactly one of said two successive values of said predetermined parameter.

2. The method of claim 1 wherein the predetermined parameter reflects speech signal power.

3. The method of claim 2 wherein the predetermined parameter reflects signal power of a characteristic waveform.

4. The method of claim 1 wherein the predetermined parameter is classified based on the two consecutive coded parameter value signals.

5. The method of claim 4 wherein the step of classifying the predetermined parameter comprises classifying the predetermined parameter based on a numerical difference between the values represented by the two consecutive coded parameter value signals.

6. The method of claim 1 wherein the categories include a linear interpolation category and a step function category;

the step of generating the intermediate parameter value signals comprises generating intermediate parameter value signals representing values which are (i) numerically less than the greater of the values of the predetermined parameter represented by the two consecutive coded parameter value signals, and (ii) numerically greater than the lessor of the values of the predetermined parameter represented by the two consecutive coded parameter value signals, when the predetermined parameter has been classified into the linear interpolation category; and the step of generating the intermediate parameter value signals comprises generating intermediate parameter value signals representing values numerically equal to one of the values of the predetermined parameter represented by the two consecutive coded parameter value signals when the predetermined parameter has been classified into the step function category.

7. The method of claim 6 wherein the step of generating the intermediate parameter value signals comprises generating at least two intermediate parameter value signals including a first intermediate parameter value signal and a second intermediate parameter value signal when the predetermined parameter has been classified into the step function category, the first intermediate parameter value signal and the second intermediate parameter value signal representing different numerical values of the predetermined parameter.

8. The method of claim 7 wherein the predetermined parameter reflects signal power of a characteristic waveform.

9. The method of claim 1 wherein the coded speech signal further comprises a coded parameter feature signal reflecting one or more values of the predetermined parameter at times between the times of the two consecutive coded parameter value signals, and wherein the classifying step comprises classifying the predetermined parameter based on the coded parameter feature signal.

10. The method of claim 9 wherein the coded signal comprises a coded speech signal.

11. The method of claim 10 wherein the predetermined parameter reflects speech signal power.

12. The method of claim 11 wherein the plurality of categories comprises a category reflecting a presence of a speech signal power plosive and a category reflecting an absence of a speech signal power plosive.

13. A method of coding a speech signal, the method comprising the steps of:

generating a sequence of coded parameter value signals representing successive values of a predetermined parameter at successive times;

classifying the predetermined parameter into one of a plurality of categories based on one or more values of the predetermined parameter at times between the times of two consecutive ones of said coded parameter value signals; and generating a coded parameter feature signal based on the category into which the predetermined parameter has been classified, wherein the plurality of categories include at least one of (i) an interpolation category representing that the coded parameter feature signal is to be decoded by generating one or more intermediate parameter value signals based on an interpolation of the two successive values of said predetermined parameter which correspond to said two consecutive ones of said coded parameter value signals; and (ii) a step function category representing that the coded parameter feature signal is to be decoded by generating one or more intermediate parameter value signals based on exactly one of said two successive values of said predetermined parameter which correspond to said two consecutive ones of said coded parameter value signals.

14. The method of claim 13 wherein the predetermined parameter reflects speech signal power.

15. The method of claim 14 wherein the plurality of categories comprises a category reflecting a presence of a speech signal power plosive and a category reflecting an absence of a speech signal power plosive.

16. A decoder for decoding a coded speech signal, the coded signal comprising a sequence of coded parameter value signals representing successive values of a predetermined parameter at successive times, the coded signal further comprising a coded intermediate parameter values signal representing values of the predetermined parameter at one or more times between the times of two of said successive values of the predetermined parameter, the decoder comprising:

means for classifying the predetermined parameter into one of a plurality of categories based on the coded intermediate parameter values signal;

means for generating, based on the category into which the predetermined parameter has been classified, one or more intermediate parameter value signals representing values of the predetermined parameter at one or more times between two consecutive ones of the coded parameter value signals; and means for decoding the coded speech signal based on the one or more intermediate parameter value signals.

wherein the plurality of categories include at least one of (i) an interpolation category representing that each of said one or more intermediate parameter value signals is to be generated based on an interpolation of said two successive values of said predetermined parameter; and (ii) a step function category representing that each of said one or more intermediate parameter value signals is to be generated based on exactly one of said two successive values of said predetermined parameter.

17. The decoder of claim 16 wherein the predetermined parameter reflects speech signal power.

18. The decoder of claim 17 wherein the predetermined parameter reflects signal power of a characteristic waveform.

19. The decoder of claim 16 wherein the predetermined parameter is classified based on the two consecutive coded parameter value signals.

20. The decoder of claim 19 wherein the means for classifying the predetermined parameter comprises means for classifying the predetermined parameter based on a numerical difference between the values represented by the two consecutive coded parameter value signals.

21. The decoder of claim 16 wherein the categories include a linear interpolation category and a step function category;

the means for generating the intermediate parameter value signals comprises means for generating intermediate parameter value signals representing values which are (i) numerically less than the greater of the values of the predetermined parameter represented by the two consecutive coded parameter value signals, and (ii) numerically greater than the lessor of the values of the predetermined parameter represented by the two consecutive coded parameter value signals, when the predetermined parameter has been classified into the linear interpolation category; and the means for generating the intermediate parameter value signals comprises means for generating intermediate parameter value signals representing values numerically equal to one of the values of the predetermined parameter represented by the two consecutive coded parameter value signals when the predetermined parameter has been classified into the step function category.

22. The decoder of claim 21 wherein the means for generating the intermediate parameter value signals comprises means for generating at least two intermediate parameter value signals including a first intermediate parameter value signal and a second intermediate parameter value signal when the predetermined parameter has been classified into the step function category, the first intermediate parameter value signal and the second intermediate parameter value signal representing different numerical values of the predetermined parameter.

23. The decoder of claim 22 wherein the predetermined parameter reflects signal power of a characteristic waveform.

24. The decoder of claim 16 wherein the coded speech signal further comprises a coded parameter feature signal reflecting one or more values of the predetermined parameter at times between the times of the two consecutive coded parameter value signals, and wherein the means for classifying the predetermined parameter comprises means for classifying the predetermined parameter based on the coded parameter feature signal.

25. The decoder of claim 24 wherein the coded signal comprises a coded speech signal.

26. The decoder of claim 25 wherein the predetermined parameter reflects speech signal power.

27. The decoder of claim 26 wherein the plurality of categories comprises a category reflecting a presence of a speech signal power plosive and a category reflecting an absence of a speech signal power plosive.

28. An encoder for coding a speech signal, the encoder comprising:

means for generating a sequence of coded parameter value signals representing successive values of a predetermined parameter at successive times;

means for classifying the predetermined parameter into one of a plurality of categories based on one or more values of the predetermined parameter at times between the times of two consecutive ones of said coded parameter value signals; and means for generating a coded parameter feature signal based on the category into which the predetermined parameter has been classified, wherein the plurality of categories include at least one of (i) an interpolation category representing that the coded parameter feature signal is to be decoded by generating one or more intermediate parameter value signals based on an interpolation of the two successive values of said predetermined parameter which correspond to said two consecutive ones of said coded parameter value signals: and (ii) a step function category representing that the coded parameter feature signal is to be decoded by generating one or more intermediate parameter value signals based on exactly one of said two successive values of said predetermined parameter which correspond to said two consecutive ones of said coded parameter value signals.

29. The encoder of claim 28 wherein the predetermined parameter reflects speech signal power.

30. The encoder of claim 29 wherein the plurality of categories comprises a category reflecting a presence of a speech signal power plosive and a category reflecting an absence of a speech signal power plosive.

* * * * *